United States Patent [19]

Lax et al.

[11] Patent Number: 4,514,029

[45] Date of Patent: Apr. 30, 1985

[54] SHIELDED CONNECTOR AND METHOD OF FORMING SAME

[75] Inventors: Ronald G. Lax, Los Gatos; Robert G. Johnson, Santa Clara; Charles G. Henningsen, Portola Valley; J. Scott Ellis, San Jose, all of Calif.

[73] Assignee: Quintec Interconnect Systems, Mountain View, Calif.

[21] Appl. No.: 374,287

[22] Filed: May 3, 1982

[51] Int. Cl.[3] ..... H01R 13/504; H01R 13/658

[52] U.S. Cl. ..... 339/143 R; 29/277; 339/218 R

[58] Field of Search ..... 339/143, 218 R, 29–277

[56] References Cited

U.S. PATENT DOCUMENTS

| | | | |
|---|---|---|---|
| 3,718,887 | 2/1973 | Solomon et al. | 339/218 M X |
| 3,744,128 | 7/1973 | Fisher et al. | 339/143 R X |
| 3,977,755 | 8/1976 | Edel et al. | 339/143 R |
| 4,120,553 | 10/1978 | Muz | 339/91 R |
| 4,337,989 | 7/1982 | Asick et al. | 339/143 R |

FOREIGN PATENT DOCUMENTS

| | | |
|---|---|---|
| 2224397 | 12/1972 | Fed. Rep. of Germany . |
| 2613907 | 4/1979 | Fed. Rep. of Germany . |

*Primary Examiner*—Eugene F. Desmond

*Attorney, Agent, or Firm*—Roylance, Abrams, Berdo & Goodman

[57] ABSTRACT

A shielded connector for a shielded electrical cable which reduces radio frequency and other electro-magnetic interference. The shielded connector comprises a pair of opposed, interconnected shield members enclosing insulated conductors extending from the cable and a unitary outer housing enclosing the shield members. The shield members are electrically connected and bonded at opposite ends to a metallic connector housing and a shield layer extending from the cable. Adhesive is interposed between the outer housing and the shield members and cable. The shield members have neck portions that are connected to the shield layer in the cable.

11 Claims, 11 Drawing Figures

SHIELDED CONNECTOR AND METHOD OF FORMING SAME

FIELD OF THE INVENTION

The invention relates to a shielded connector for a shielded electrical cable which reduces radio frequency and other electro-magnetic interference.

BACKGROUND OF THE INVENTION

In electrical cables used, for example, in computer equipment, the electronic signals carried by the cables generate and are interferred with by radio frequency and other electro-magnetic interference. To reduce this interference, the electrical cables are usually formed with a conductive foil or braided shield layer interposed between an outer insulating jacket and the inner insulated conductors. While this cable shielding is effective to reduce a large amount of the interference, it is also highly desirable to shield the connectors at the ends of these electrical cables.

While it is known to provide such connector shielding, the prior art devices are deficient in many respects. For one thing, they are relatively expensive to manufacture since they utilize numerous pieces and expensive machined parts. In addition, many of these prior art devices do not effectively establish electrical continuity from the cable through the connector and to ground, which results in the unwanted interference. Many of these prior art devices also utilize potting material to rigidly enclose the insulated conductors and pins and sockets used in the connector, eliminating the desirable self-alignment floating condition of these pins and sockets. Moreover, many of these prior art connectors are large, bulky and aesthetically displeasing. Many of these prior art devices also allow easy access to the insulated conductors inside the connector, resulting in the possibility of tampering with the connection to the terminal block and therefore possible damage to the equipment. In addition, many of these devices do not provide adequate strain relief so that the cable can be pulled away from the connector. Examples of these prior art devices are disclosed in the following U.S. Pat. Nos.: 3,718,387 to Solomon et al; 3,744,128 to Fisher et al; 3,977,755 to Edel et al; and 4,120,553 to Muz.

SUMMARY OF THE INVENTION

Accordingly, a primary object of the invention is to provide an inexpensive, yet effective, shielded connector that provides electrical continuity from the cable to ground.

Another object of the invention is to provide such a shielded connector that does not utilize potting material in conjunction with the insulated conductors of electrical cable and that is light weight and aesthetically pleasing.

Another object is to provide such a shielded connector that is essentially tamper proof and has a high degree of strain relief.

The foregoing objects are basically attained by providing in a shielded connector for a shielded cable including a cable having a plurality of insulated conductors, an outer insulating jacket enclosing the conductors and a shielded layer interposed between the conductors and the jacket with the conductors and the shield layer extending past an end of the insulating jacket; and a metallic connector housing coupled to an insulated terminal block which supports terminals electrically connected to the conductors, the improvement comprising: a pair of opposed rigid shield members located between the connector housing and the end of the insulating jacket and receiving the insulated conductors extending past the jacket therebetween; means for interconnecting the opposed shield members; means for electrically connecting and bonding the shield members to the shield layer; means for electrically connecting and bonding the shield members to the connector housing; and a unitary outer housing enclosing the opposed shield members, a portion of the connector housing and a portion of the insulating jacket therein.

Other objects, advantages and salient features of the invention will become apparent from the following detailed description, which, taken in conjunction with the annexed drawings, discloses preferred embodiments of the invention.

DRAWINGS

Referring now to the drawings which form a part of this original disclosure:

DETAILED DESCRIPTION OF THE INVENTION

Figure 1:
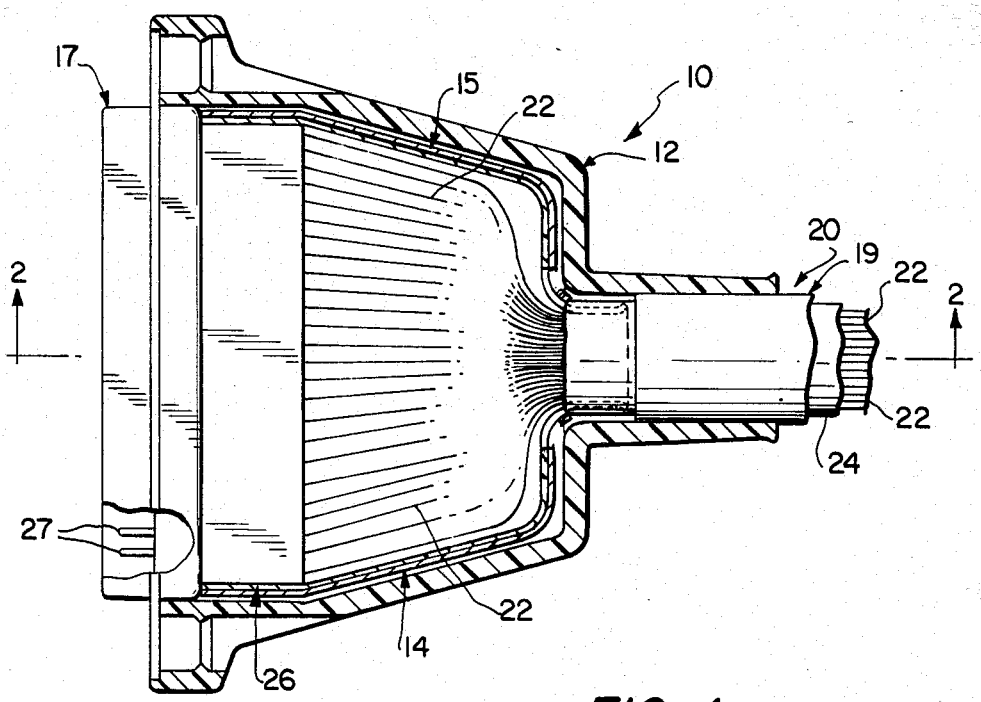
FIG. 1 is an elevational view in longitudinal section of the shielded connector of the present invention in assembled form.

Referring now to FIGS. 1–6, the first embodiment of the invention is shown in which the shielded connector 10 comprises a unitary hollow outer housing 12 and a pair of opposed, interconnected shield members 14 and 15. The shield members are located between a metallic connector housing 17 and the end of the insulating jacket 19 on the outside of the electrical cable 20. This cable has a plurality of individually insulated conductors 22 therein which are electrically connected to terminals 27 supported by an insulated terminal block 26 which is coupled to the connector housing 17. A metallic shield layer 24 formed as a foil or braided conductive member is interposed between the insulated conductors and the insulating jacket. To provide electrical continuity between the cable 20 and the connector housing 17, the shield members 14 and 15 are electrically connected and bonded at opposite ends to the connector housing 17 and shield layer 24. This is accomplished by means of soldering, brazing, sprayed metal, mechanical fastening, welding or a conductive adhesive such as metal filled epoxy as will be described in detail hereinafter.

Figure 3:
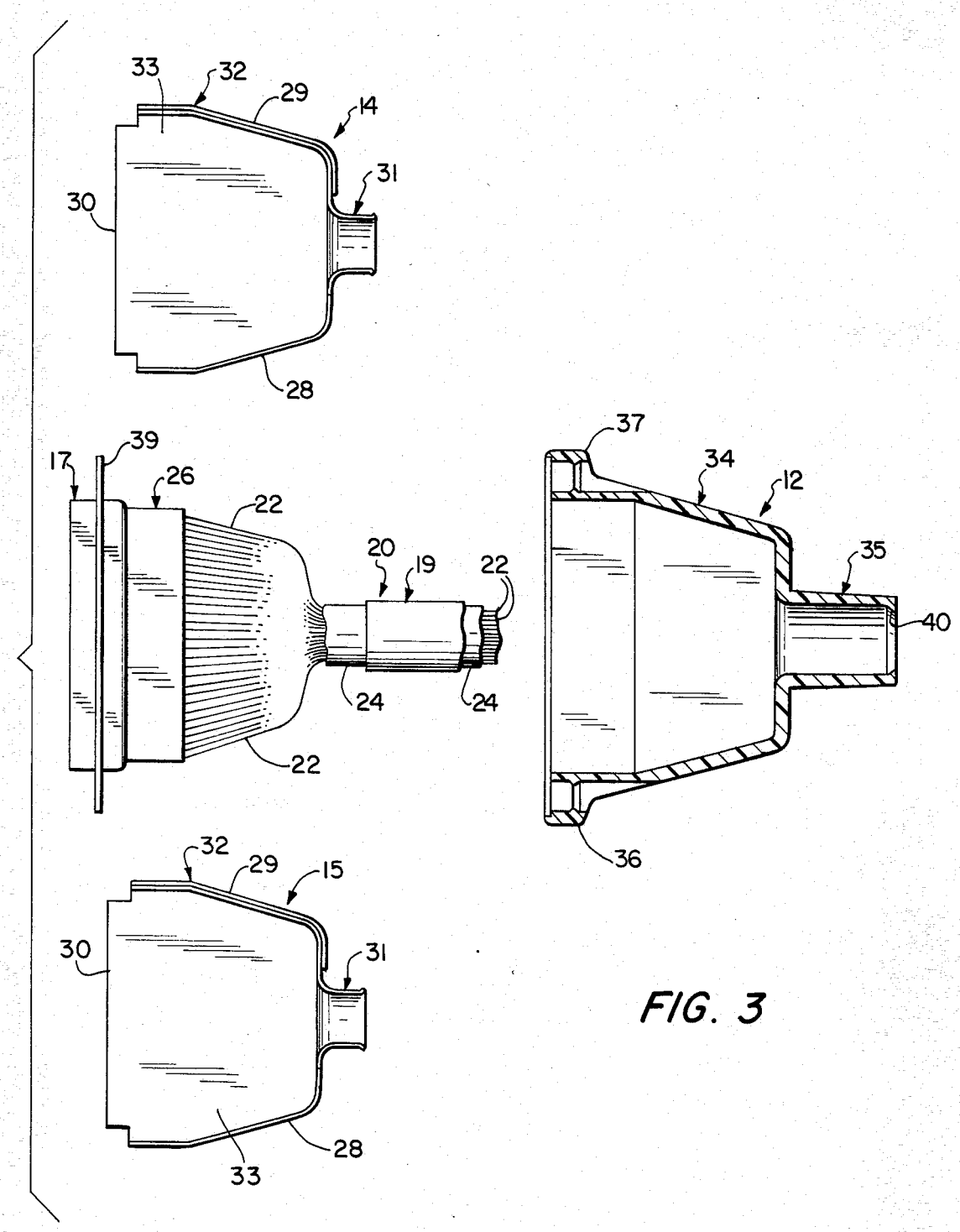
FIG. 3 is a reduced elevational view in exploded form of the parts of the invention shown assembled in FIGS. 1 and 2.

As seen best in FIG. 3, the cable 20 has a part of the shield layer 24 extending past an end and likewise has the insulated conductors 22 extending past the same end. As seen in FIG. 1, these conductors are electrically connected in a conventional manner to terminals 27, i.e., male pins or female sockets, in the insulated terminal block 26 coupled to and extending outwardly of connector housing 17.

Figure 4:
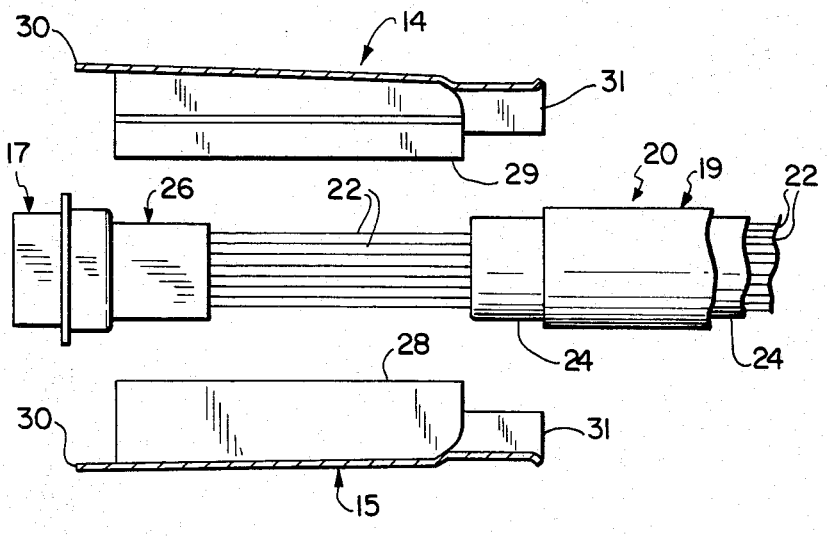
FIG. 4 is an exploded bottom plan view of the two shield members about to enclose the insulated conductors extending between the electrical cable and the connector housing and terminal block.

The two shield members 14 and 15 are made from metal and are identical in configuration so that they can telescope or nest as shown in FIG. 4. This is accomplished by forming the opposite depending sides so that one side has a flat elongated tang 28 and the other side has an outwardly bent elongated flange 29. At the end of the shield member to be connected to the connector housing is a straight lip 30 and at the opposite end to be connected to the shield member is a reduced neck portion 31. Thus, each shield member has a main body portion 32 including a planar outer wall 33 defined by the tang 28, flange 29, lip 30 and neck portion 31 with the neck portion 31 extending therefrom. Each shield member is formed as a unitary element such as by stamping. In plan view, the main body portion is basically formed in a rectangular configuration leading into a trapezoidal configuration which leads into the neck portion 31. The lip 30 extends from the rectangular configuration.

Figure 2:
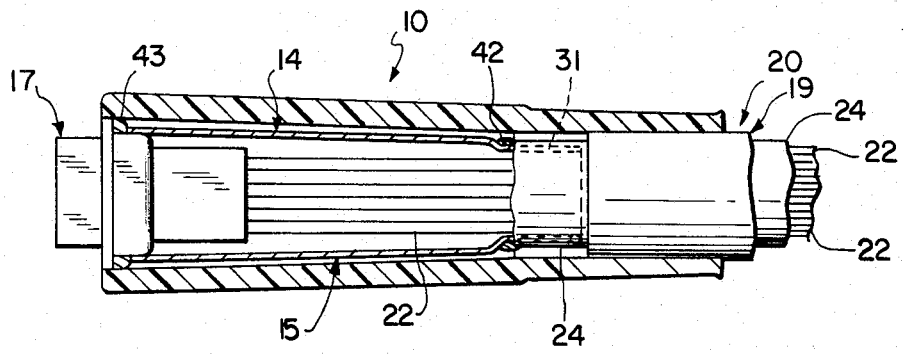
FIG. 2 is a bottom plan view in section of the connector shown in FIG. 1 taken along line 2—2 in FIG. 1.

The outer housing 12 shown in FIG. 3 has basically the same overall configuration as each shield member including a main body portion 34 and a neck portion 35 with the addition of a pair of bored flanges 36 and 37 extending outwardly from the main body portion for the reception of mounting screws. Corresponding bores are made in the central flange 39 in the connector housing so that the mounting screws can pass therethrough. The main body portion 34 and neck portion 35 of the outer housing 12 are formed as a unitary member, the neck portion 35 receiving the cable 20 and the neck portions of the shield members 14 and 15 therein as seen in FIGS. 1 and 2. The distal end of neck portion 35 has an upwardly and inwardly tapering frustoconical surface 40 to frictionally grip the outer surface of the cable as the outer housing slides over that cable. The outer housing is advantageously formed of molded plastic and is longitudinally symmetrical as shown in the drawings.

Figure 5:
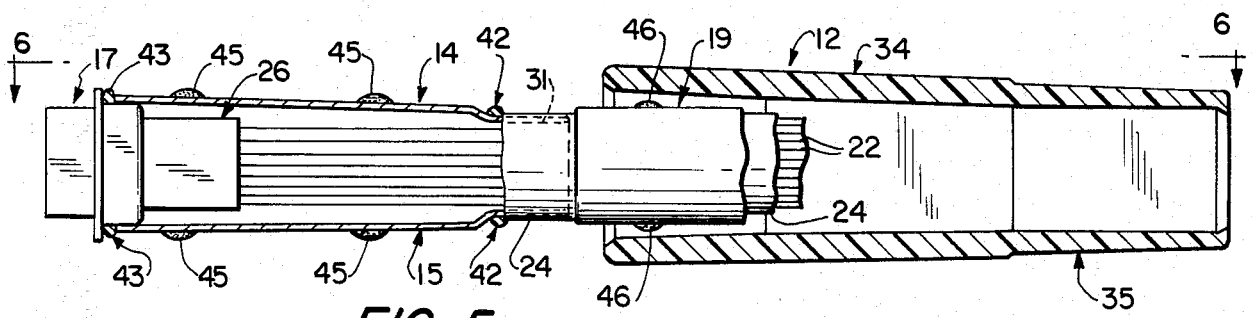
FIG. 5 is a view similar to that shown in FIG. 4 except that the shield members have been interconnected and electrically connected and bonded to the connector housing and shield layer in the cable with the outer housing about to be moved over the shield members.
Figure 6:
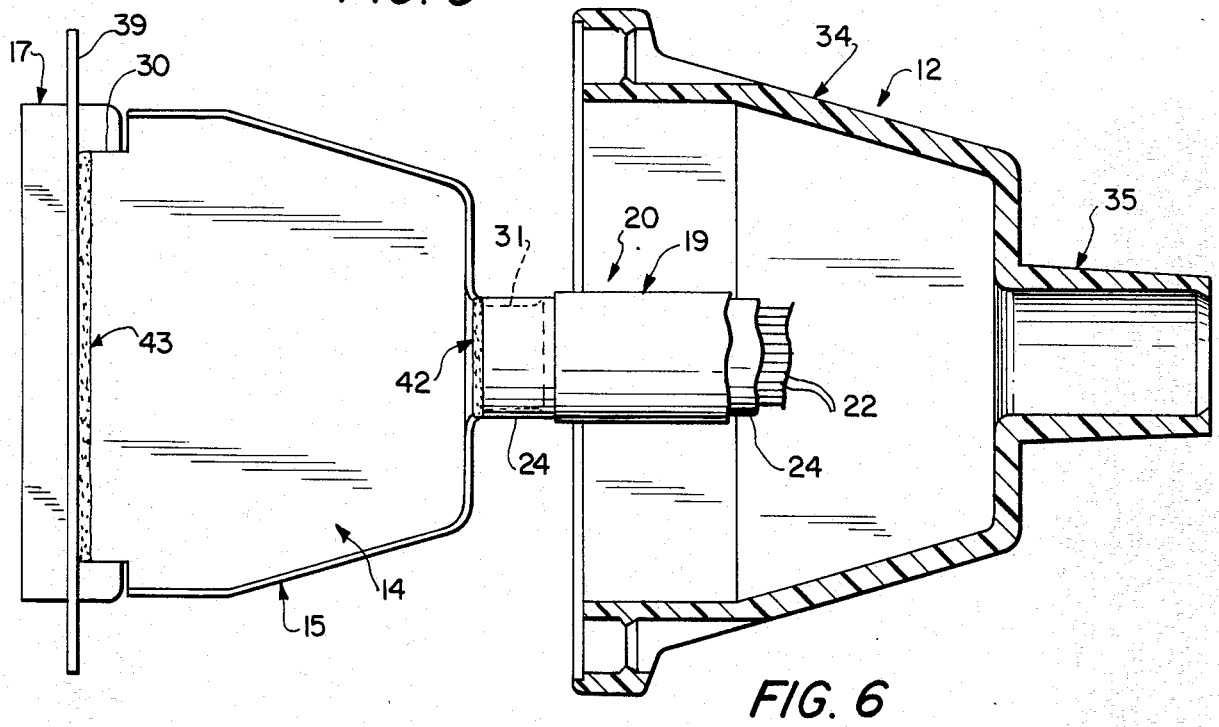
FIG. 6 is an elevational view taken along line 6—6 in FIG. 5.

As best seen in FIGS. 5 and 6, the electrical connection and bonding between the shield members and the shield layer is generally indicated at 42 and such electrical connection and bonding between the shield members and the connector housing is generally indicated at 43. Advantageously as shown in FIGS. 5 and 6, the shield layer 24 overlaps the neck portions 31 on the shield members and is directly electrically connected and bonded to the shield members as shown by reference numeral 42. At the other ends of the shield members this bonding and electrical connection takes place between the lips 30 on the shield members and the area of the connector housing adjacent central flange 39. As mentioned above, this electrical connection and bonding is accomplished by solder material, brazing material, sprayed metal, welding, a mechanical fastening device or conductive adhesive.

As seen in FIG. 5, adhesive or potting material 45 is applied to the outside of the shield members 14 and 15 to adhere them to the outer housing 12. Similarly, adhesive 46 is applied to the cable adjacent the exposed shield layer 24 to adhere the neck 35 of the outer housing directly to the cable. This increases the strain relief of the connector.

FORMING THE CONNECTOR OF FIGS. 1–6

To form the connector 10 as shown in FIGS. 1 and 2, the various parts shown in FIG. 3 are coupled in the sequence shown in FIGS. 4–6.

Thus, the insulated conductors 22 in the cable 20 are electrically connected to terminals 27 in terminal block 26 which is coupled to the metallic connector housing 17, with the conductors 22 and the shield layer 24 extending past an end of the insulating jacket 19.

Then, the insulated conductors extending from the insulating jacket are enclosed by the pair of opposed shield members 14 and 15, with these shield members being interconnected via flanges 29 and tangs 28. At the same time, as seen in FIGS. 5 and 6, the neck portions 31 on the shield members are overlapped by the shield layer 24.

Next, the shield members are electrically connected and bonded at one end to the shield layer extending from the insulating jacket and at the other end to the metallic connector housing 17. This is shown in FIG. 5.

Following this, adhesive material 45 and 46 is located on the shield members and on the cable, and the outer housing 12 is slid along the cable to a position in which it encloses the shield member, a portion of the connector housing and a portion of the insulating jacket. This final connected position is shown in FIGS. 1 and 2.

EMBODIMENT OF FIGS. 7–11

As shown in FIGS. 7–11, a second embodiment of a shielded connector 10′ in accordance with the present invention includes the same basic elements as discussed above regarding FIGS. 1–6. Thus, the shielded connector 10′ includes an outer housing 12′, and a pair of opposed shield members 14′ and 15′ for use in connection with a connector housing 17′ and cable 20′.

Cable 20′ is basically the same as that discussed above regarding FIGS. 1–6 and includes an insulating jacket 19′, a foil layer 24′ and a plurality of insulated conductors 22′. These conductors are electrically connected to terminals supported by the terminal block 26′ which is coupled to the metallic connector housing 17′ as discussed above; however, in this embodiment terminal block 26′ has a pair of transverse grooves 49 and 50 as best seen in FIGS. 7, 8, 9 and 10.

Figure 7:
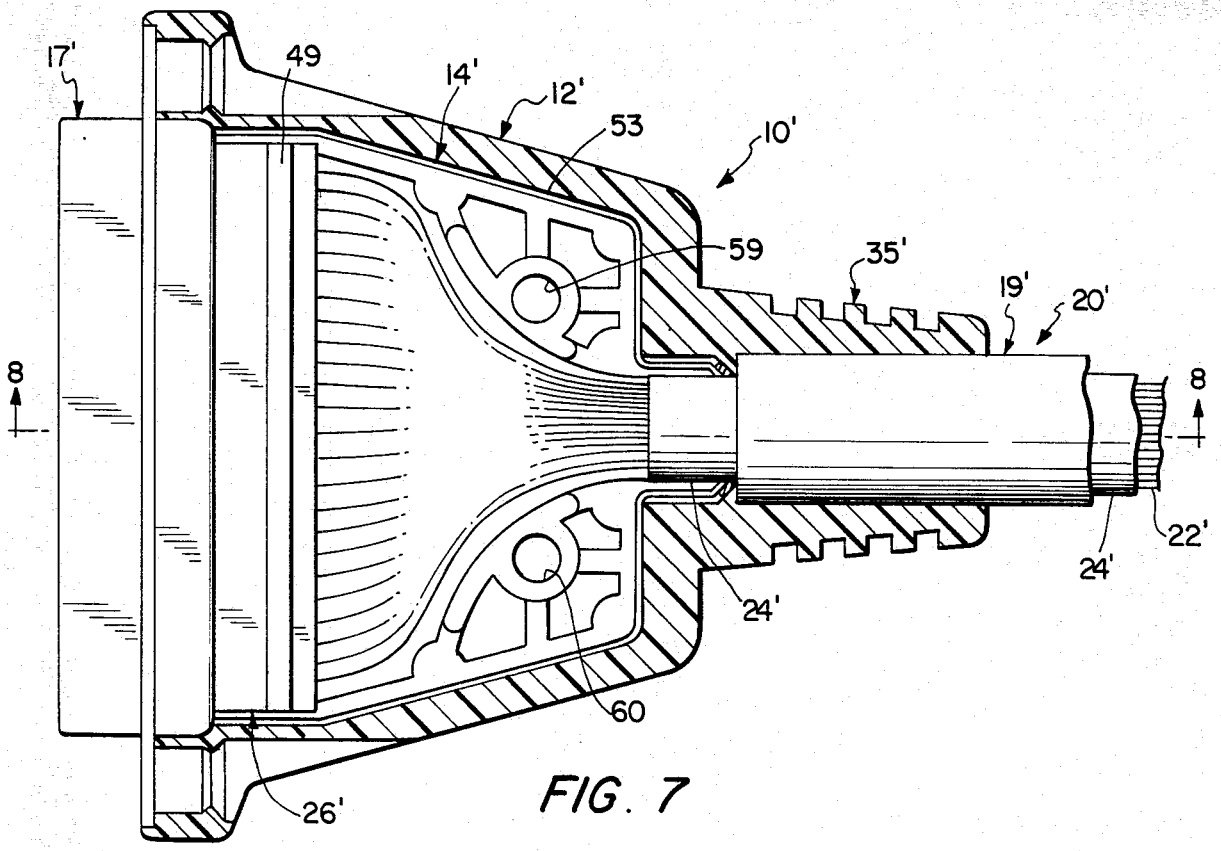
FIG. 7 is an elevational view in longitudinal section of a modified embodiment of the present invention.
Figure 8:
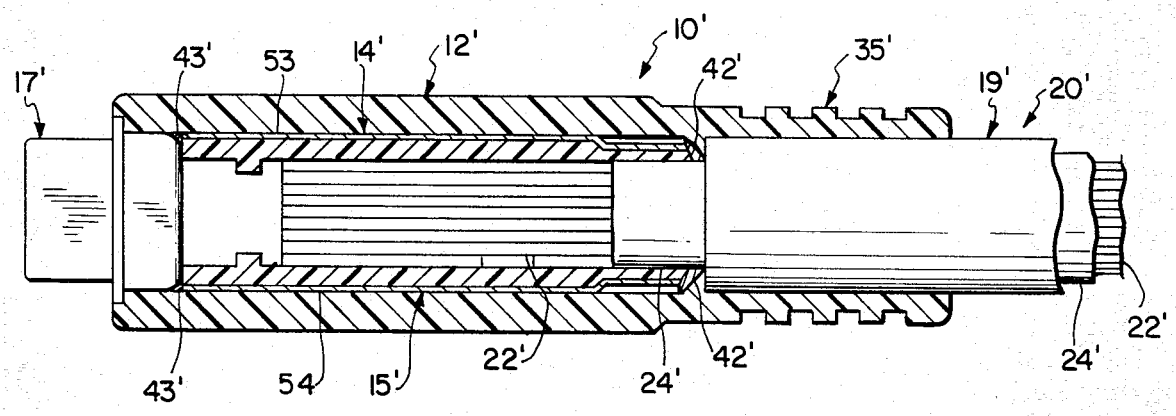
FIG. 8 is a bottom plan view of the connector shown in FIG. 7 taken along line 8—8 in FIG. 7.
Figure 9:
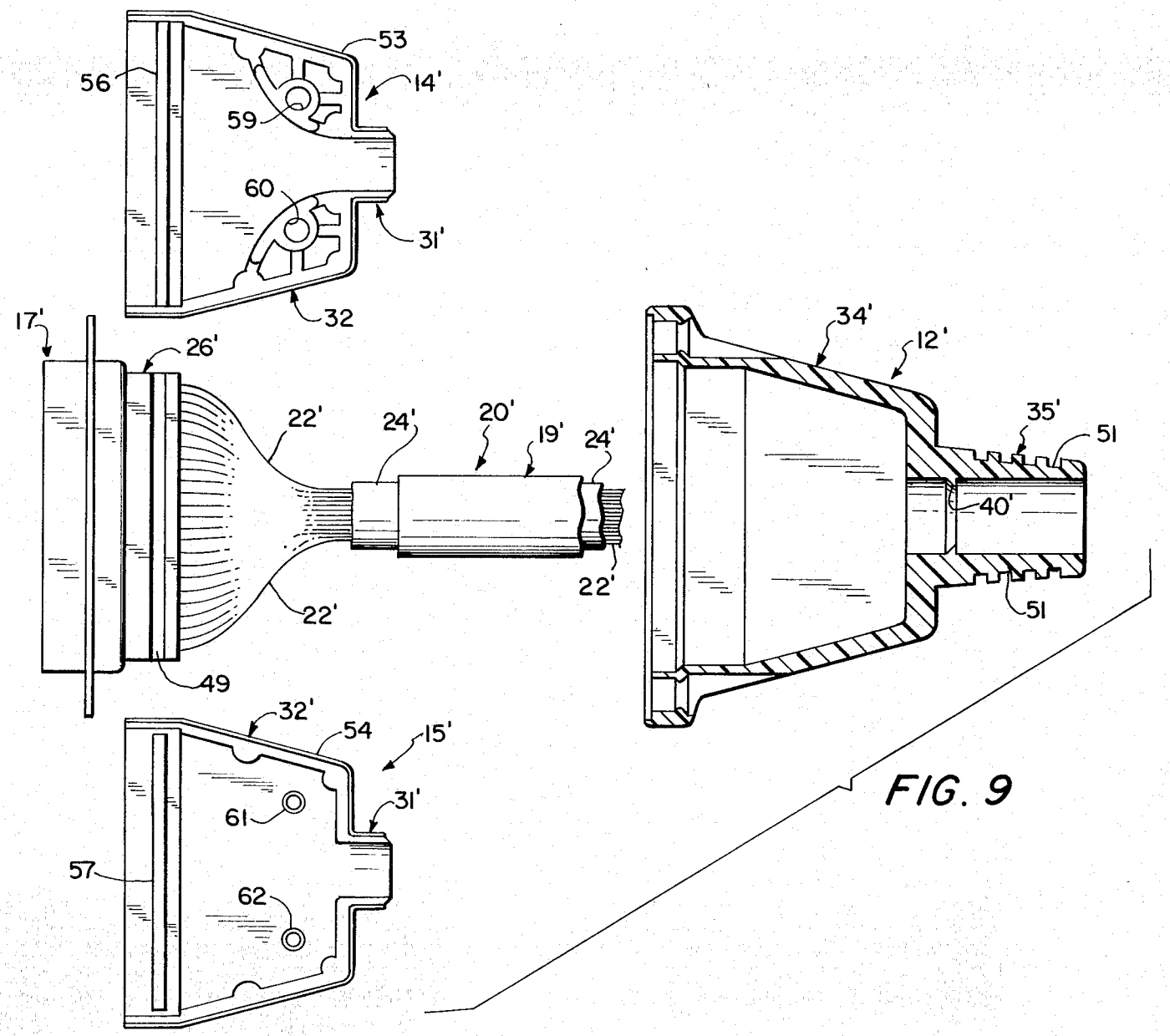
FIG. 9 is a reduced elevational view in exploded form of the connector illustrated in FIG. 7.

The outer housing 12′ is basically the same as housing 12 discussed above except that the frustoconical surface 40′ is moved longitudinally inwardly from the distal end of neck portion 35′ as best seen in FIG. 9. As seen in FIGS. 7 and 8, the annular member formed by this frustoconical surface provides a stop for the end of insulating jacket 19′. The outer surface of the neck portion 35′ has a series of annular grooves 51 to add flexibility to the neck portion. The main body portion 34′ of the outer housing 12′ remains the same as the main body portion 34 discussed above regarding housing 12.

Figure 11:
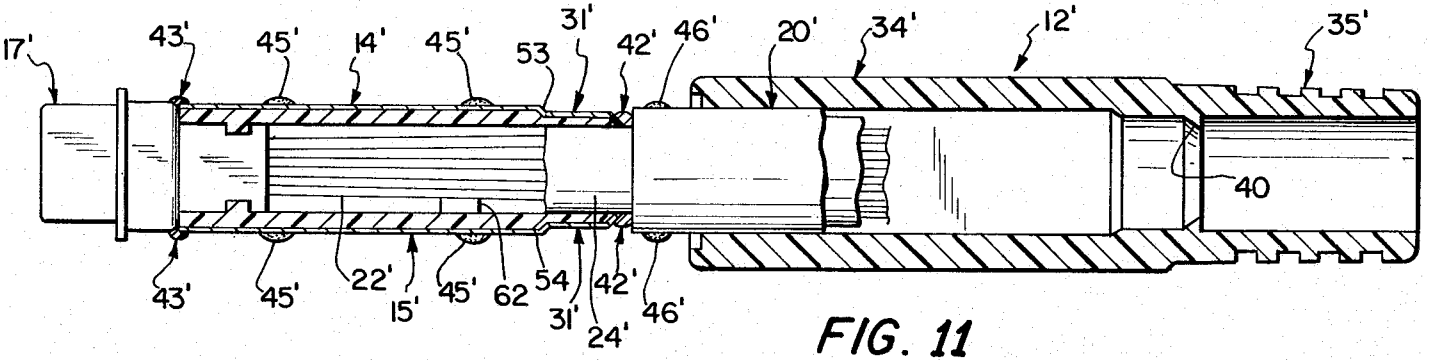
FIG. 11 is a view similar to that shown in FIG. 10 except that the two shield members have been interconnected and electrically connected and bonded to the connector housing and shield layer in the cable and the outer housing is about to be moved over the shield members.

The shield members 14′ and 15′ are in this embodiment formed from plastic material and have an outer surface lined with a metal layer 53 for shield member 14′ and 54 for shield member 15′. Each shield member has a main body portion 32′ and a neck portion 31′. The outer configuration of these shield members is substantially the same as shield members 14 and 15. On the inside of these shield members are a pair of transverse ribs, rib 56 being associated with shield member 14′ and rib 57 being associated with shield member 15′. These ribs will fit into grooves 49 and 50 in the terminal block 26′ as seen in FIGS. 7, 8 and 11. In addition, shield member 14′ has a pair of spaced bosses defining a pair of tubular sockets 59 and 60. These sockets receive, when the shield members are interconnected, a pair of transversely spaced tubular pins 61 and 62 extending from the main body portion of shield member 15′. Advantageously, the pins and sockets fit together in a tight, pressed fit to keep the two shield members together.

FORMING THE CONNECTOR OF FIGS. 7–11

The method of forming the second embodiment of the invention is essentially the same as that described above regarding FIGS. 1–6 except for a few small differences.

Figure 10:
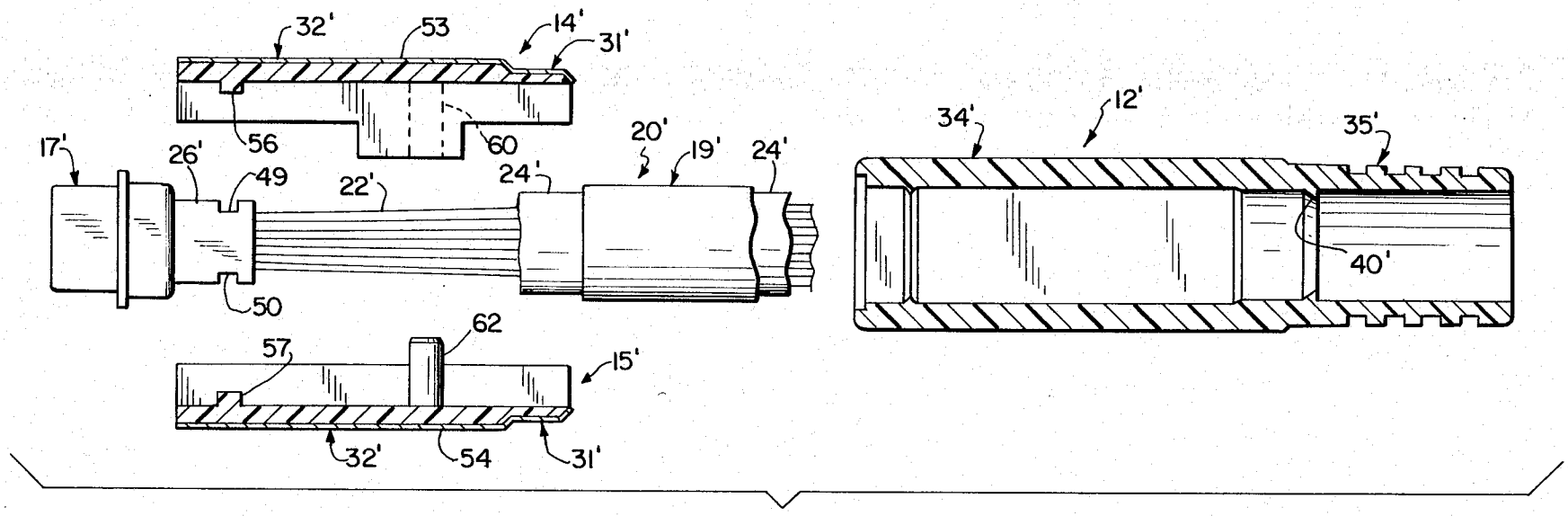
FIG. 10 is a view similar to that shown in FIG. 8 except in exploded form.

Thus, the insulated conductors 22′ are first electrically connected to terminals supported by the terminal block 26′ which is coupled to the metallic connector housing 17′ as seen in FIG. 10.

Then, the insulated conductors 22′ extending from the insulating jacket 19′ are enclosed with the pair of opposed shield members 14′ and 15′ with these shield members being interconnected by having the pins 61 and 62 being received in sockets 59 and 60.

In addition, the neck portions 31′ on shield members 14′ and 15′ are overlapped over the foil layer 24′ as seen in FIG. 11. Then, the shield members are electrically connected and bonded to the metallic connector housing and to the shield layer extending from the insulating jacket by means of soldering, brazing, welding or other suitable mechanisms with an electrical connection being made between the outer metal layers 53 and 54 on the shield members and the shield layer and metallic connector housing. This is shown in FIG. 11 with the electrical connection and bonding being designated by reference numerals 42′ and 43′.

Next, adhesive material 45′ is applied to the metal layers 53 and 54 and adhesive material 46′ is applied to the outer surface of the insulating jacket 19′, as seen in FIG. 11. Then, the outer housing 12′ is slided along the cable 20′ until it fully encloses the shield members, a portion of the connector housing and a portion of the insulating jacket. This is shown in FIGS. 7 and 8.

As best seen in FIGS. 8 and 11, in the assembled condition grooves 49 and 50 on the insulating block 26′ receive the ribs 56 and 57 therein.

While advantageous embodiments have been chosen to illustrate the invention, it will be understood by those skilled in the art that various changes and modifications can be made therein without departing from the scope of the invention as defined in the appended claims. For example, to add further strain relief to the embodiment of FIGS. 1–6, the neck portions 31 can be crimped around the foil layer and insulated conductors by a crimping device or a split ring can be placed over these neck portions, or both of these can be done. In addition, rather than forming each shield member from metal or from plastic with a metal outer surface, the shield members can be formed of plastic and have a metallic lining on the inner or outer surfaces which can be formed by a metallic coating, foil or spray. Alternatively, a conductive filler can be used in the plastic material forming the shield member to render it conductive.

What is claimed is:

1. In a shielded connector for a shielded cable including a cable having a plurality of insulated conductors, an outer insulating jacket enclosing the conductors and a shield layer interposed between the conductors and the jacket with the conductors and the shield layer extending past an end of the insulating jacket; and a metallic connector housing coupled to an insulated terminal block which supports terminals electrically connected to the conductors, the improvement comprising:

a pair of opposed, rigid shield members located between the connector housing and the end of the insulating jacket and receiving the insulated conductors extending past the jacket therebetween;

means for interconnecting said opposed shield members;

means for electrically connecting and bonding said shield members to the shield layer;

means for electrically connecting and bonding said shield members to the connector housing;

a unitary, preformed and self-supporting outer housing enclosing said opposed shield members, a portion of the connector housing, and a portion of the insulating jacket therein, said outer housing comprising a continuous tube; and adhesive means interposed between said outer housing and said shield members and between said outer housing and said portion of said insulating jacket so enclosed.

2. In a shielded connector for a shielded cable including a cable having a plurality of insulated conductors, an outer insulating jacket enclosing the conductors and a shield layer interposed between the conductors and the jacket with the conductors and the shield layer extending past an end of the insulating jacket; and a metallic connector housing coupled to an insulated terminal block which supports terminals electrically connected to the conductors, the improvement comprising:

a pair of opposed, rigid shield members located between the connector housing and the end of the insulating jacket and receiving the insulated conductors extending past the jacket therebetween;

means for interconnecting said opposed shield members;

means for electrically connecting and bonding said shield members to the shield layer;

means for electrically connecting and bonding said shield members to the connector housing;

a unitary, preformed and self-supporting outer housing enclosing said opposed shield members, a portion of the connector housing, and a portion of the insulating jacket therein, said outer housing comprising a continuous tube; and adhesive means interposed between said outer housing and said portion of said insulating jacket so enclosed.

3. A method of forming a shielded connector for a shielded cable including a cable having a plurality of insulated conductors, an outer insulating jacket enclosing the conductors and a shield layer interposed between the conductors and the jacket with the conductors and the shield layer extending past an end of the insulating jacket; and a metallic connector housing coupled to an insulated terminal block supporting terminals, comprising the steps of electrically connecting the insulated conductors to the terminals, enclosing the insulated conductors extending from the insulating jacket with a pair of opposed shield members and interconnecting the shield members, electrically connecting and bonding the shield members to the metallic connector housing and to the shield layer extending from the insulating jacket, preforming a unitary and self-supporting outer housing as a continuous tube, and enclosing the shield members, a portion of the connector housing and a portion of the insulating jacket with the unitary, preformed and self-supporting outer housing by sliding the outer housing thereover, the second enclosing step including the step of coupling the outer housing to the shield members to prevent relative axial movement therebetween.

4. A method according to claim 3, wherein the second electrically connecting step includes applying a conductive bonding material between the shield members and the metallic connector housing and between the shield members and the shield layer.

5. A method according to claim 3, wherein the second electrically connecting step is preceded by the step of overlapping a portion of the shield layer onto a portion of the shield members.

6. A method according to claim 3, wherein the second electrically connecting step is preceded by the step of overlapping a portion of the shield members onto a portion of the shield layer.

7. A method according to claim 3, wherein the step of coupling the outer housing to the shield members comprises bonding the housing to the shield members.

8. A method according to claim 3, wherein the second enclosing step further includes the step of coupling the outer housing to the portion of the insulating jacket so enclosed to prevent relative axial movement therebetween.

9. A method according to claim 8, wherein the step of coupling the outer housing to the portion of the insulating jacket so enclosed comprises bonding the housing to the portion of the insulating jacket so enclosed.

10. A method of forming a shielded connector for a shielded cable including a cable having a plurality of insulated conductors, an outer insulating jacket enclosing the conductors and a shield layer interposed between the conductors and the jacket with the conductors and the shield layer extending past an end of the insulating jacket; and a metallic connector housing coupled to an insulated terminal block supporting terminals, comprising the steps of electrically connecting the insulated conductors to the terminals, enclosing the insulated conductors extending from the insulating jacket with a pair of opposed shield members and interconnecting the shield members, electrically connecting and bonding the shield members to the metallic connector housing and to the shield layer extending from the insulating jacket, preforming a unitary and self-supporting outer housing as a continuous tube, and enclosing the shield members, a portion of the connector housing and a portion of the insulating jacket with the unitary, preformed and self-supporting outer housing by sliding the outer housing thereover, the second enclosing step being preceded by the step of interposing an adhesive between the outer housing and the shield members and between the outer housing and the portion of the insulating jacket so enclosed.

11. A method of forming a shielded connector for a shielded cable including a cable having a plurality of insulated conductors, an outer insulating jacket enclosing the conductors and a shield layer interposed between the conductors and the jacket with the conductors and the shield layer extending past an end of the insulating jacket; and a metallic connector housing coupled to an insulated terminal block supporting terminals, comprising the steps of electrically connecting the insulated conductors to the terminals, enclosing the insulated conductors extending from the insulating jacket with a pair of opposed shield members and interconnecting the shield members, electrically connecting and bonding the shield members to the metallic connector housing and to the shield layer extending from the insulating jacket, preforming a unitary and self-supporting outer housing as a continuous tube, and enclosing the shield members, a portion of the connector housing and a portion of the insulating jacket with the unitary, preformed and self-supporting outer housing by sliding the outer housing thereover, the second enclosing step including the step of adhesively bonding the outer housing to the portion of the insulating jacket so enclosed to prevent relative axial movement therebetween.

* * * * *